US005345785A

United States Patent [19]

Sekigami et al.

[11] Patent Number: 5,345,785

[45] Date of Patent: Sep. 13, 1994

[54] SCROLL COMPRESSOR AND AIR CONDITIONER USING THE SAME

[75] Inventors: Kazuo Sekigami; Kenichi Oshima, both of Tochigi; Masahiro Takebayashi, Tsuchiura, all of Japan

[73] Assignee: Hitachi, Ltd., Tokyo, Japan

[21] Appl. No.: 969,375

[22] Filed: Oct. 30, 1992

[30] Foreign Application Priority Data

Oct. 30, 1991 [JP] Japan ..... 3-284618

[51] Int. Cl.[5] ..... F25B 43/02; F04C 18/02; F04C 29/02

[52] U.S. Cl. ..... 62/468; 62/469; 62/84; 418/55.6; 418/96

[58] Field of Search ..... 62/84, 469, 468; 418/55.6, 96

[56] References Cited

U.S. PATENT DOCUMENTS

| | | | |
|---|---|---|---|
| 4,818,198 | 4/1989 | Tamura et al. | 418/96 X |
| 4,958,991 | 9/1990 | Kikuchi | 418/55.6 |
| 5,012,896 | 5/1991 | Da Costa | 418/96 X |
| 5,110,268 | 5/1992 | Sakurai et al. | 418/55.6 X |

FOREIGN PATENT DOCUMENTS

| | | | |
|---|---|---|---|
| 48-33042 | 11/1973 | Japan . | |
| 62686 | 4/1985 | Japan | 418/96 |
| 212689 | 9/1986 | Japan | 418/55.6 |
| 87894 | 3/1989 | Japan | 418/55.6 |
| 96488 | 4/1989 | Japan | 418/55.6 |
| 123297 | 5/1990 | Japan | 418/96 |
| 173390 | 7/1990 | Japan | 418/96 |
| 4022787 | 1/1992 | Japan | 418/55.6 |

*Primary Examiner*—Henry A. Bennett
*Assistant Examiner*—Christopher B. Kilner
*Attorney, Agent, or Firm*—Antonelli, Terry, Stout & Kraus

[57] ABSTRACT

A horizontal-installation-type scroll compressor requiring small installation space adopts a technique which can reduce the amount of refrigerating machine oil circulating through the refrigeration cycle. By using this scroll compressor, an air conditioner is provided whose unit body has a reduced depth and which has satisfactory ventilation efficiency and cyclic efficiency.

The scroll compressor includes a closed container which is separated into a section lodging an electric motor and a compression mechanism and a section where a discharge pipe is provided. Refrigerating machine oil is stored in the section including the discharge pipe in order to ensure the requisite amount of refrigerating machine oil. An oil separation mechanism is provided in the passage of the refrigerant gas so that refrigerant gas containing little amount of refrigerating machine oil may be sent out from the discharge pipe. Further, electrical parts and this scroll compressor are arranged below a heat exchange section equipped with a heat exchanger and a centrifugal fan, thus forming an outdoor unit.

18 Claims, 8 Drawing Sheets

SCROLL COMPRESSOR AND AIR CONDITIONER USING THE SAME

BACKGROUND OF THE INVENTION

This invention relates to a scroll compressor and an air conditioner using the same and, in particular, to a scroll compressor which has a simple structure and which can be installed in a horizontal position, and to an air conditioner using a scroll compressor which is advantageous in terms of space saving and reduction in size and which is suitable for attaining an improvement in reliability and efficiency.

Scroll compressors have recently come to be employed which, due to their structural principles, are advantageous in reducing vibrations and noise in compressors. However, due to limitations regarding the oil feeding structure, etc., most of them are of a vertical-installation type.

To reduce the height of the refrigerating unit or to minimize installation space, it is more advantageous for the compressor to be installed in a horizontal position. A structure to meet this requirement is disclosed, for example, in Japanese Patent Unexamined Publication No. 64-87894.

In view of the space limitations in houses in relation to the demand for air conditioners, a reduction in size and noise and an enhancement in performance are required. Further, an improvement in their appearance is also regarded as significant.

A technique has been proposed in Japanese Patent Unexamined Publication No. 2-169938 to meet these requirements and, in particular, to attain a reduction in size of the outdoor unit.

Refrigerating machine oil is generally sealed in a compressor in order to ensure the requisite reliability of the sliding parts thereof and to make the temperature distribution inside the compressor uniform. The refrigerating machine oil is mixed with refrigerant gas, and the viscosity of the refrigerating machine oil in the mixed state is lower than in the non-mixed state. Thus, to ensure a level of viscosity high enough to maintain the requisite reliability, the amount of refrigerating machine oil is inevitably determined by the amount of refrigerant gas sealed in.

The prior-art technique disclosed in Japanese Patent Unexamined Publication No. 64-87894, mentioned above, is excellent in respect to the oil feeding structure when installed in the horizontal position. However, to ensure the requisite amount of refrigerating machine oil while preventing the oil surface from being disturbed by the rotor of the motor, the longitudinal dimension of the closed container must be large. Thus, although this prior-art technique helps to achieve the object of reducing the height of the refrigerating unit to a low level, it is not regarded as satisfactory in terms of reducing the installation space required.

The outdoor unit of the air conditioner disclosed in Japanese Patent Unexamined Publication No. 2-169938, mentioned above, includes a machine chamber provided below the heat exchange chamber. Its blower for sucking in outside air is a mixed-flow fan, and a panel having blowout holes through which air can be blown out from the circumference of the unit body, is provided in front of the mixed-flow fan. Arranged in the machine chamber are electrical parts and the compressor, the structure of which is not disclosed in the specification.

In this outdoor unit, the blower consists of a large-size mixed-flow fan, and the compressor consists of a standard horizontal-installation-type closed electric compressor. Further, the panel in front of the fan has air passages for leading the air flow from the mixed-flow fan to the circumferential portion of the unit body. Thus, the structure of this outdoor unit is rather complicated, no sufficient consideration being given to efficiency in blowing. Also, this outdoor unit is not regarded as satisfactory in respect to reducing the size and simplifying the structure of the out-door unit.

SUMMARY OF THE INVENTION

This invention has been made with a view towards solving the above problems in the prior art. It is a first object of this invention to provide a scroll compressor of a horizontal-installation type which requires a small space for installation.

A second object of this invention is to provide a scroll compressor which can reduce the amount of refrigerating machine oil mixed with the refrigerant gas discharged from the compressor so as to circulate through the refrigeration cycle, thereby preventing a reduction in the amount of oil inside the compressor and improving the reliability thereof and which makes it possible to reduce the pressure loss inside the refrigeration cycle, thereby achieving improved efficiency.

A third object of this invention is to provide a highly reliable scroll compressor which collects all foreign matter contained in the lubricating oil supplied from an oil feeding pipe to the sliding parts.

A fourth object of this invention is to provide a scroll compressor whose unit body excels in stability and can be formed with reduced depth and which has high ventilation efficiency and low pressure loss of the refrigerant, thereby providing high cyclical efficiency.

To achieve the first object, there is provided, in accordance with a first aspect of this invention, a scroll compressor of the type which includes a closed container lodging an electric motor and a compression mechanism connected to the electric motor through a crankshaft, the compression mechanism including at least two scrolls each having a spiral lap protruding straight from an end plate, the two scrolls being engaged with each other with their laps being on the inner side, one scroll making an orbiting movement relative to the other scroll while being prevented from rotating, the scroll compressor being installed in such a way that the above-mentioned crankshaft is maintained substantially horizontal, wherein a separation plate is provided which is resistant to gaseous fluid and which separates the interior of the closed container into a space for lodging the electric motor and the compression mechanism and a space having a discharge pipe for transferring compressed refrigerant gas to an outer cycle, and wherein a communicating section to allow communication between the two separated spaces is provided in the section of the separation plate which is below the center of rotation of the electric motor.

More specifically, a back chamber is provided on the side opposite to the lap of the scroll which makes an orbiting movement, the pressure of the back chamber being kept somewhere between a suction pressure and a discharge pressure; a sub-bearing is provided in the vicinity of that end of the crankshaft which is on the opposite side of the joint section leading to the compression mechanism; a support plate for supporting the sub-bearing is provided which is held by the inner peripheral surface of the closed container and which has a cutout below a position corresponding to the outer periphery of the rotor constituting the electric motor; a cup covering the sub-bearing is secured to that section of the support plate which is on the side of the shaft end of the crankshaft, the cup having an oil feeding pipe extending downwards; and a separation plate is provided between the oil feeding pipe and the support plate, a gas passage being provided between the separation plate and the support plate.

Further, the interior of the closed container is separated into a section which lodges the electric motor and the compression mechanism and a section which includes a discharge pipe for transmitting compressed refrigerant gas to the condenser of a refrigeration cycle; in operation, the pressure of the refrigerant gas discharged from the compression mechanism is utilized, and refrigerating machine oil is stored in the section which includes the discharge pipe, whereby the refrigerating machine oil is protected from disturbance by the rotor of the electric motor while ensuring the requisite amount of refrigerating machine oil.

To achieve the second object, mentioned above, there is provided, according to a second aspect of this invention, a scroll compressor wherein a pipe is attached to a communication hole provided in the support plate to form a gas passage, wherein the discharge outlet of the pipe is situated within a predetermined dimension from the inner wall of the closed container, and wherein an oil separator is provided in each or either of the communication holes provided in the support plate and the separation plate, or in an inner wall section of the closed container opposed to the discharge outlet of the compression mechanism.

That is, an oil separation mechanism is provided at an appropriate position in the refrigerant gas passage, and some of the refrigerating machine oil contained in the refrigerant gas discharged from the compression mechanism is removed from the gas, thereby allowing the discharge pipe to emit refrigerant gas mixed with a relatively small amount of refrigerating machine oil.

To achieve the above-mentioned third object, there is provided, according to a third aspect of this invention, a scroll compressor, wherein a magnet is attached to the suction inlet of the oil feeding pipe so that any foreign matter may be adsorbed, or a spiral oil plate is provided in the interior of the oil feeding pipe and an enlarged space is formed in a part of the interior so that any foreign matter may be collected therein.

To achieve the above-mentioned fourth object, there is provided, according to a fourth aspect of this invention, an air conditioner comprising a heat exchanger, a blower for introducing outside air to the heat exchanger, and a machine chamber provided below them, the machine chamber lodging at least electrical parts and a horizontal-installation-type scroll compressor according to the present invention.

More specifically, the blower consists of a centrifugal blower whose blade section is situated in front of the heat exchanger, outside air being sucked in from the back surface of the heat exchanger and blown out toward the outer periphery of the centrifugal blower. Further, the outer casing of the air conditioner is formed as a box having a small depth which is substantially square as seen from the front, the front surface of the centrifugal blower being formed of a decorative panel.

The above-described technical means provided the following effects:

In the first aspect of this invention, the interior of the closed container is separated into a section lodging the electric motor and the compression mechanism and a section equipped with a discharge pipe for transmitting compressed refrigerant gas to the condenser of the refrigeration cycle. Further, provided in the boundary portion between the two separated sections are a support plate which also serves as a sub-bearing holder, and a separation plate arranged in such a way as to leave a gap between it and the support plate. By passing refrigerant gas through this gap, refrigerating machine oil is stored in the section equipped with the discharge pipe, and the refrigerating machine oil is prevented from being disturbed by the rotor of the electric motor while ensuring the requisite amount of refrigerating machine oil. Further, refrigerant gas is prevented from leaking into the stored refrigerating machine oil to cause bubbles therein.

In the second aspect of this invention, a pipe is attached to a section of the refrigerant gas passage in which the gas flow rate is relatively high, and refrigerant gas is led to the vicinity of the inner wall of the closed container and caused to impinge upon the inner wall at high speed so as to separate the oil and gas components of the refrigerant gas from each other, or net-like resistant members are provided in a section where the gas flow rate is relatively high, and the oil and gas components of the refrigerant gas are separated from each other as the gas passes through that section, thereby allowing the compressor to emit refrigerant gas mixed with a relatively small amount of refrigerating machine oil.

In the third aspect of this invention, a magnet is attached to the suction inlet of the oil feeding pipe, thereby adsorbing any foreign matter. Or, a spiral oil plate is provided in the interior of the oil feeding pipe, and an enlarged space is formed in a part of the interior. Due to this arrangement, a rotating movement is imparted to the oil flowing through the oil feeding path, thereby making it possible to centrifugally collect any foreign matter in the enlarged space.

In the fourth aspect of this invention, a horizontal-installation-type scroll compressor equipped with the above-described technical means is provided in a machine chamber below a heat exchange section equipped with a heat exchanger and a blower for the heat exchanger. By employing a centrifugal fan for the blower, it is possible to suck in outside air from the back surface of the heat exchanger and to blow it out toward the outer periphery of the centrifugal fan, thereby providing satisfactory ventilation efficiency.

In the scroll compressor of this invention, vibrations are reduced, so that the number of turns for absorbing vibrations of the piping system can be reduced. Further, by arranging the compressor and electrical parts below the heat exchange section, it is possible to lower the center of gravity of the unit, thus providing a scroll compressor which excels in stability and which can be made compact with a small depth.

DESCRIPTION OF THE PREFERRED EMBODIMENTS

Embodiments of this invention will now be described with reference to FIGS. 1 through 13.

First, the general overall construction of the horizontal-installation-type scroll compressor of this invention and the functions thereof will be described with reference to FIG. 1.

Figure 1:
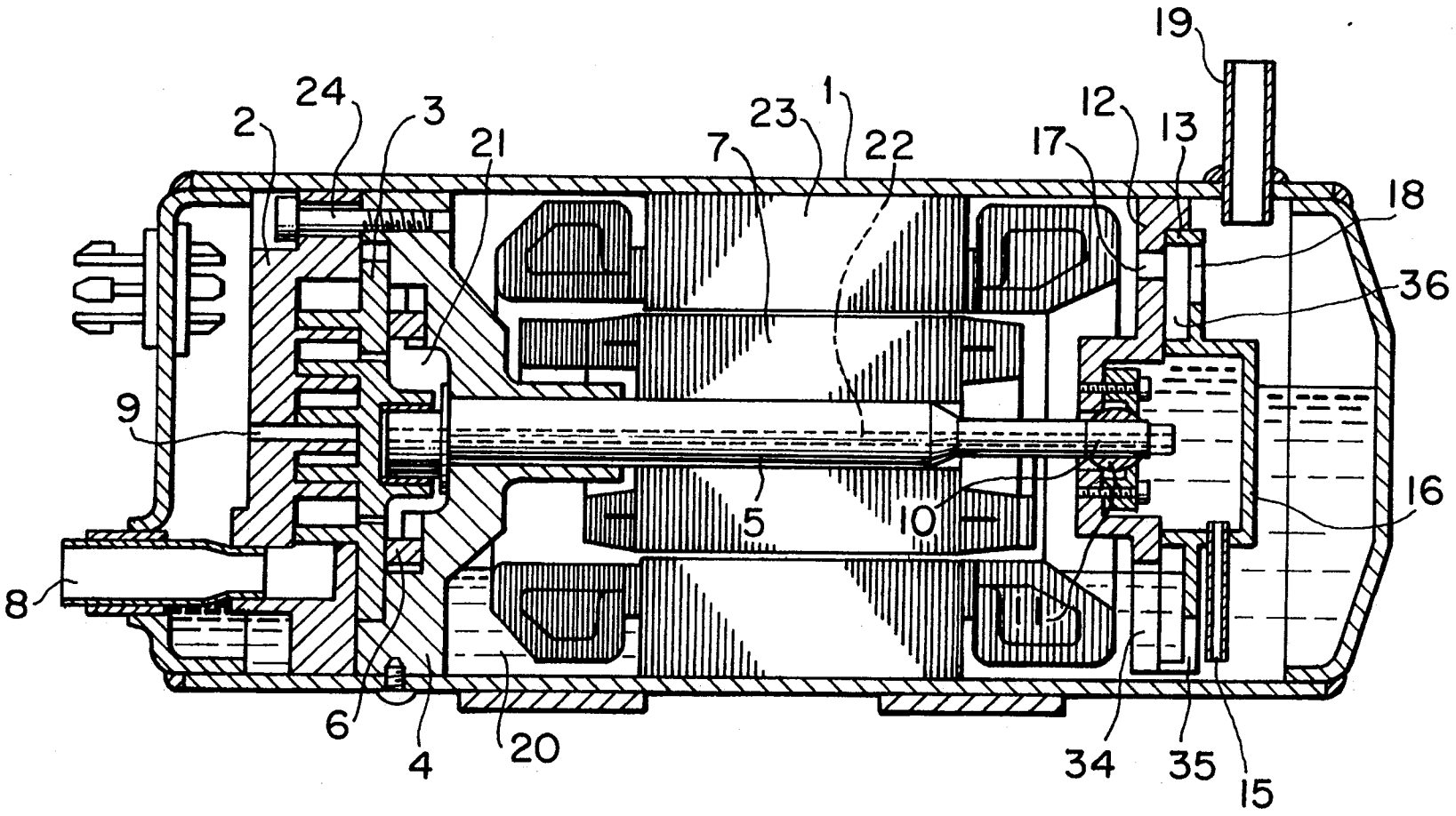
FIG. 1 is a longitudinal sectional view of a scroll compressor according to a first embodiment of this invention.

The scroll compressor shown in FIG. 1 includes a closed container 1 lodging a compression mechanism and an electric motor. The main components of the compression mechanism includes a stationary scroll 2, an orbiting scroll 3, a frame 4, a crankshaft 5, and an Oldham ring 6. A suction pipe 8 connected to an outer cycle is fitted into the suction inlet of the stationary scroll 2.

The electric motor consists of a stator 23 and a rotor 7. The stator 23 is secured to the closed container 1 by shrinkage fitting or the like. The rotor 7 is fitted onto the crankshaft 5 by press fitting or the like.

The outer periphery of the frame 4 is fastened to the closed container 1 and equipped with a bearing in which the crankshaft 5 rotates. The orbiting scroll 3 is rotatably mounted on the eccentric section of the crankshaft 5. The Oldham ring 6 is slidably fitted into grooves provided in the frame 4 and the orbiting scroll 3 in order to prevent the orbiting scroll 3 from rotating. The stationary scroll 2, which engages with the orbiting scroll 3 to define compression chambers therebetween, is fastened to the frame 4 by means of a bolt 24.

A shaft end section 10 of the crankshaft 5 which is on the opposite side of the eccentric section thereof, is supported by a sub-bearing 11, which is attached to a support plate 12 fastened to the closed container 1. The space inside a back chamber 21, which is defined by the frame 4 and the orbiting scroll 3, is kept at a pressure level somewhere between the suction pressure and the discharge pressure. The interior of the closed container 1 is at the discharge pressure. Thus, due to the resultant differential pressure, refrigerating machine oil is supplied to the sliding sections of the compressor by way of an oil feeding pipe 15 and an oil hole 22 provided inside the crankshaft 5.

The general operation of this scroll compressor will now be described.

The stator 23 applies torque to the rotor 7 to cause the crankshaft 5 to rotate and, due to the action of the Oldham ring 6, the orbiting scroll 3 makes an eccentric orbiting movement without rotating. As a result of the orbiting movement of the orbiting scroll 3, refrigerant gas, sucked in from the suction inlet of the stationary scroll 2 through the suction pipe 8, is gradually compressed in the compression chambers and discharged into the closed container 1 through a discharge port 9. The discharged refrigerant gas cools the electric motor section and is supplied to the outer cycle through a discharge pipe 19.

Next, the first embodiment of the scroll compressor of this invention will be described with reference to FIGS. 2 through 5, together with FIG. 1.

FIRST EMBODIMENT

Figure 2:
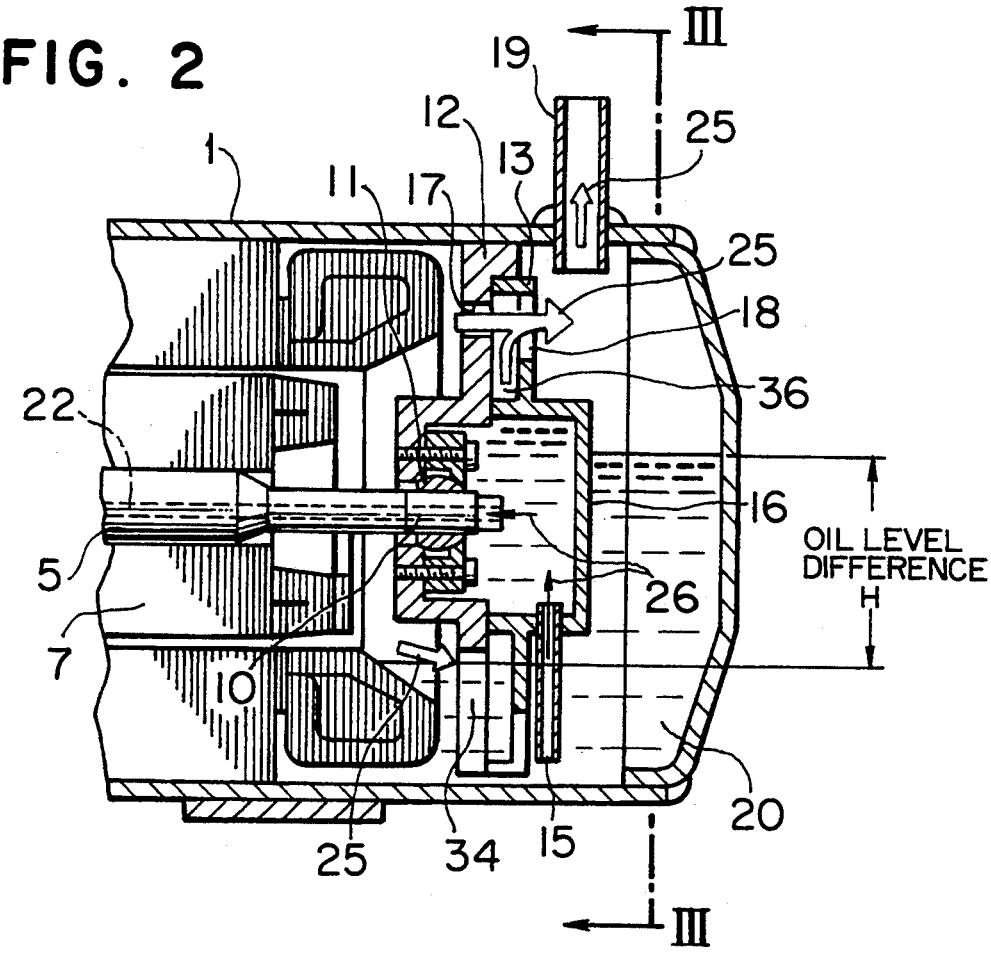
FIG. 2 is a sectional view of the essential part of FIG. 1.
Figure 3:
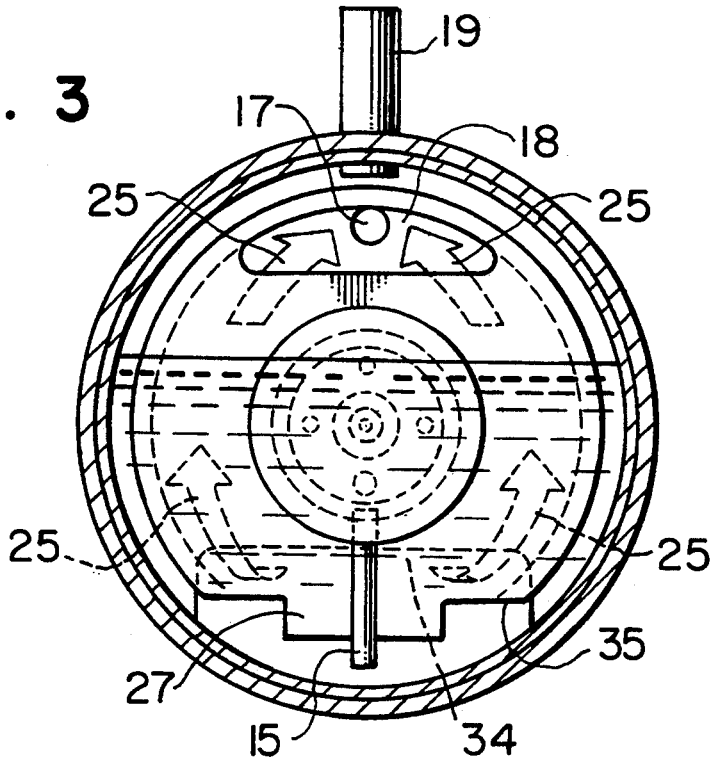
FIG. 3 is a sectional view taken in the direction of the arrow along the line III—III of FIG. 2.

In this embodiment, the interior of the closed container 1 is separated by a support plate 12, as shown in FIGS. 1 through 3. The support plate 12 includes a cutout 34 in the section thereof which is below the outer periphery of the rotor 7, and a communication hole 17 in the section thereof which is above the center of rotation of the rotor 7.

When, as a result of the rotation of the crankshaft 5, compressed refrigerant gas is discharged through the discharge port 9 of the stationary scroll 2, the pressure in the electric motor section and the rear section of the compressor increases and lowers the oil level, thereby generating an oil level difference H, which corresponds to the pressure loss of the support-plate communication hole 17.

The degree of pressure loss of the support-plate communication hole 17 is determined by the area of this communication hole, the ratio of the discharge pressure to the suction pressure, the circulating amount of refrigerant gas, etc.

The oil level difference H can be obtained by the following equation:

$$H=G^2(\zeta/2g)\cdot\{(Ps/Pd)^{1/n}/\rho A\}^2 \quad (1)$$

where G: amount of circulating refrigerant;
$\zeta$: drag coefficient;
g: gravitational acceleration;
Ps: suction pressure;
Pd: discharge pressure;
$\rho$: density of the gas sucked in;
A: area of the communication hole; and
n: polytropic exponent.

Figure 12:
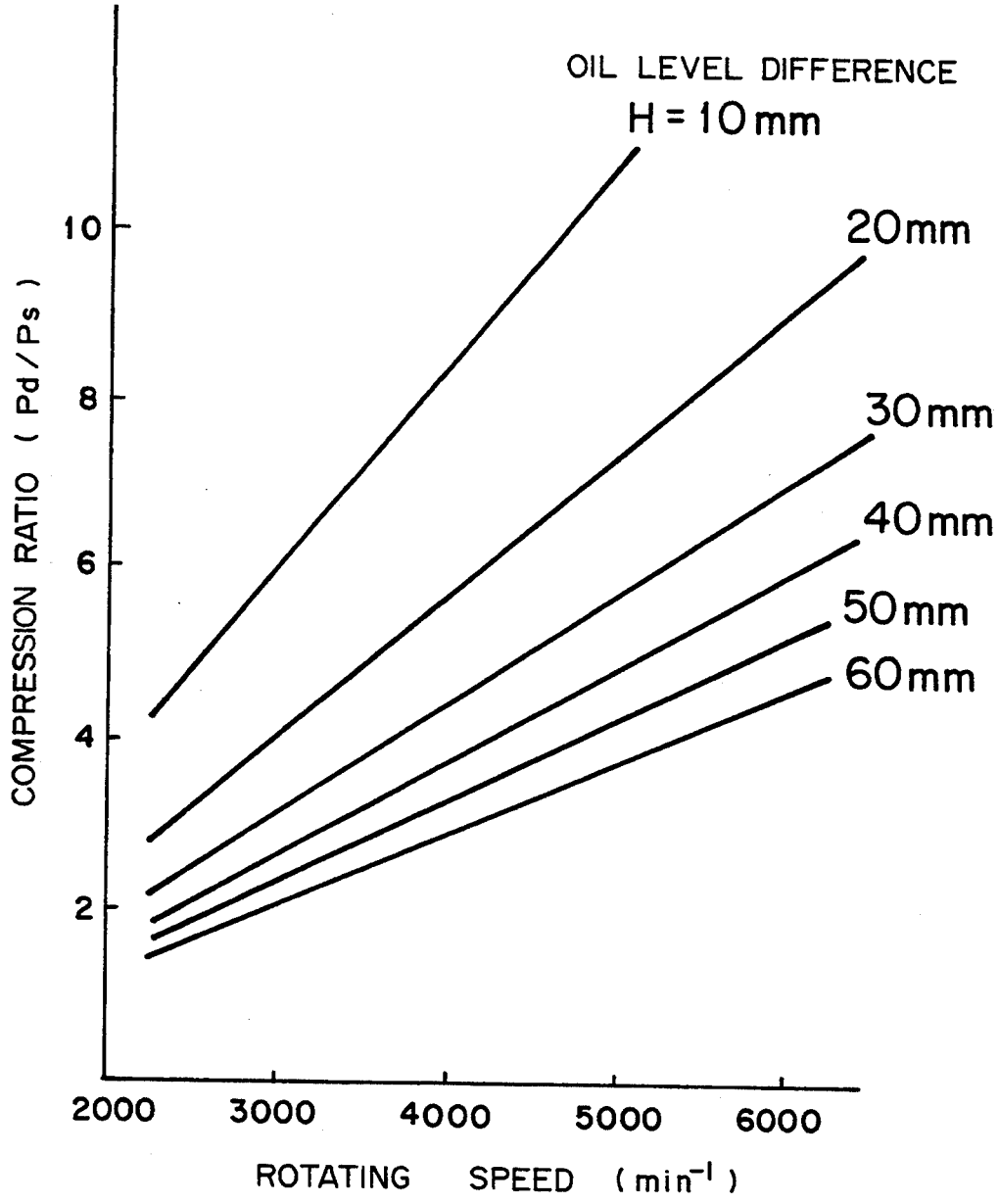
FIG. 12 is a chart showing the relationship between the operating conditions and the oil level difference in this embodiment.

FIG. 12 shows data on the oil level difference H. The horizontal axis represents rotating speed, and the vertical axis represents compression ratio (Pd/Ps).

In order that the proper oil level difference H may be maintained even when various conditions are changed, the support-plate cutout 34 of this embodiment is provided in the section of the support plate which is below the outer periphery of the rotor 7. When the oil level in the electric motor section becomes lower than the support-plate cutout 34, the portion of the refrigerant gas which cannot pass through the support-plate communication hole 17 is allowed to pass through the support-plate cutout 34 and leak into the space where the discharge pipe 19 is provided. To prevent the refrigerating machine oil from being bubbled by the gas leaking out into the space and to prevent refrigerant gas from being sucked into the oil feeding pipe 15, a cup 16 is provided which covers the sub-bearing section 11. A separation plate 13 is arranged around the cup 16, and a gas passage 36 is provided between the support plate 12 and the separation plate 13.

Thus, the portion of the gas which cannot pass through the support-plate communication hole 17 is allowed to pass through the support-plate cutout 34 and the gas passage 36 and is transmitted to the space where the discharge pipe 19 is provided through a separation-plate communication hole 18 provided in the separation plate 13. A separation-plate cutout 35 provided in the separation plate 13 extends downwards beyond the support-plate cutout 34, so that, under normal conditions, there is no danger of gas leaking into the refrigerating machine oil stored in the space where the discharge pipe 19 is provided. If the amount of discharged gas is excessively large and if by some chance some gas is allowed to leak through the separation-plate cutout 35, the reliability of the sliding sections is not impaired since a part of the separation plate 13 extends further downwards to form a gas-suction preventing plate 27 in the vicinity of the oil feeding pipe 15. Thus, the gas is allowed to leak through the sections on both sides of the gas-suction preventing plate 27, and is not sucked in through the oil feeding pipe 15, thereby preventing the reliability of the sliding parts from being impaired.

Figure 4:
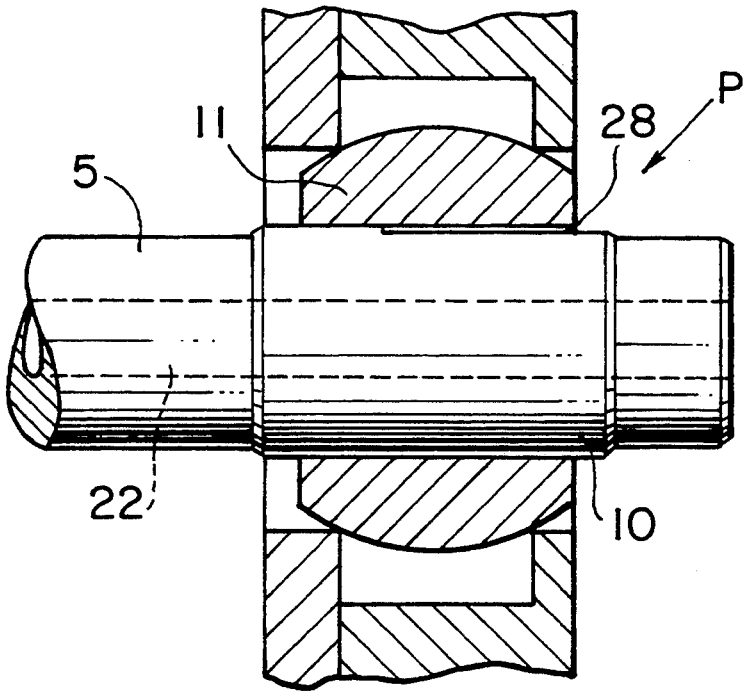
FIG. 4 is an enlarged view of a sub-bearing section.
Figure 5:
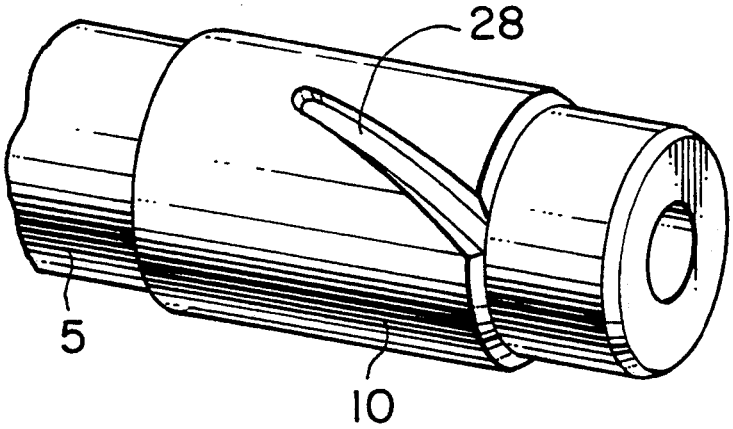
FIG. 5 is a perspective view taken in the direction of the arrow P of FIG. 4.

Further, as shown in FIGS. 4 and 5, the shaft section 10 of the crankshaft 5, fitted into the sub-bearing 11, has a spiral groove 28 extending over a range within the total length of the sub-bearing 11 (a range at least 2 mm less than the total length of the sub-bearing), thereby preventing gas intrusion from the space on the side of the electric motor and, at the same time, effecting lubrication of the bearing section.

In accordance with this embodiment, a horizontal-installation-type scroll compressor can be provided in which the requisite amount of refrigerating machine oil is sealed without augmenting the total length of the compressor, thus making it possible to realize a more compact refrigerating unit having a reduced height and requiring less space.

SECOND EMBODIMENT

Figure 6:
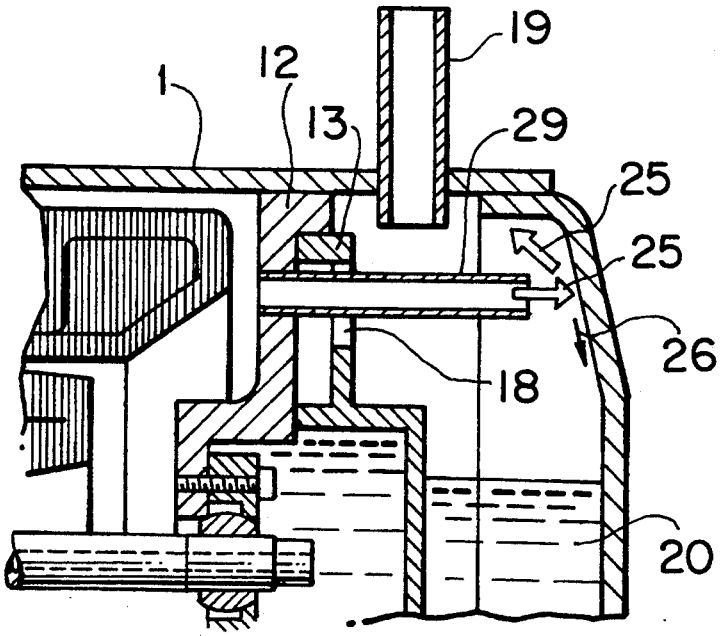
FIG. 6 is a sectional view of the essential part of an example in which oil separation is promoted by gas impingement.
Figure 7:
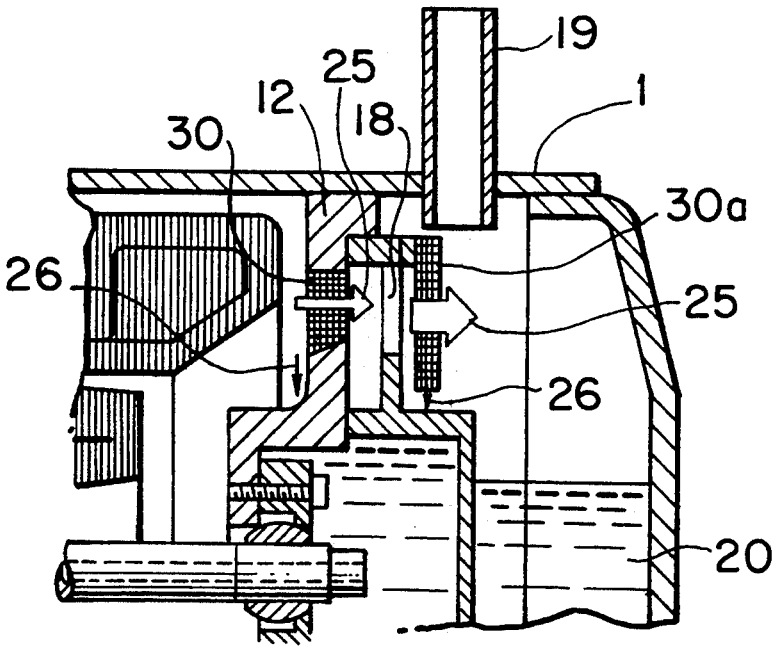
FIG. 7 is a sectional view of the essential part of an example in which oil separation is promoted by net-like resistant members.
Figure 8:
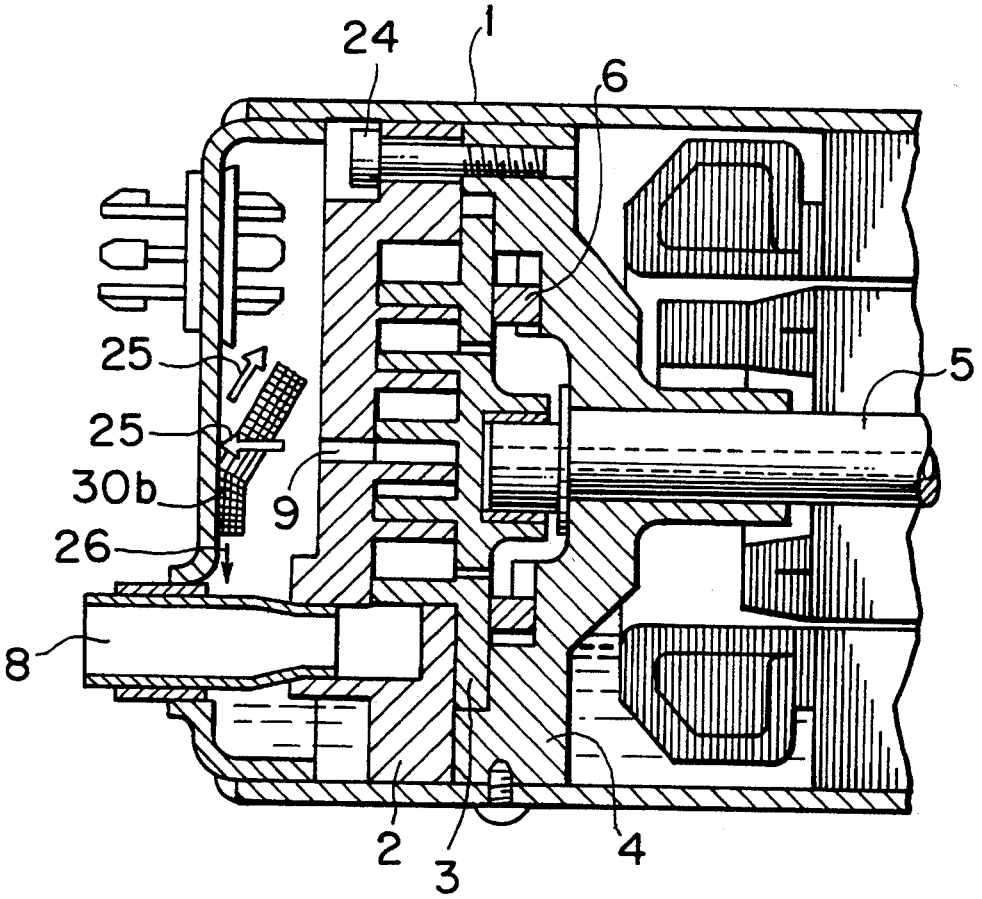
FIG. 8 is a sectional view of the essential part of an example in which oil separation is promoted by arranging the net-like resistant member in the vicinity of the discharge outlet.

Next, the second embodiment of this invention will be described with reference to FIGS. 6 to 8.

If refrigerant gas mixed with refrigerating machine oil is supplied to the refrigeration cycle, pressure loss occurs in the piping, deteriorating cyclical efficiency. As shown in FIGS. 6 to 8, the second embodiment adopts a structure having a separation pipe 29 which is provided in a flow area where the gas flow velocity is relatively high and which separates the oil component 26 (indicated by the solid-line arrow) from the gas component 25 (indicated by the blank arrows) through impingement of the gas on the inner wall of the closed container 1 (see FIG. 6), or a structure which separates the oil component 26 from the gas component 25 by passing the gas through net-like resistant members 30, 30*a* and 30*b* (see FIGS. 7 and 8).

Due to the above structures, it is possible to supply the refrigeration cycle with refrigerant gas from which the oil component has been removed to a satisfactory degree, thereby enhancing the cyclical efficiency. Further, reduction of the amount of refrigerating machine oil inside the compressor can be avoided to some extent, thereby improving the reliability of the scroll compressor.

THIRD EMBODIMENT

Figure 10:
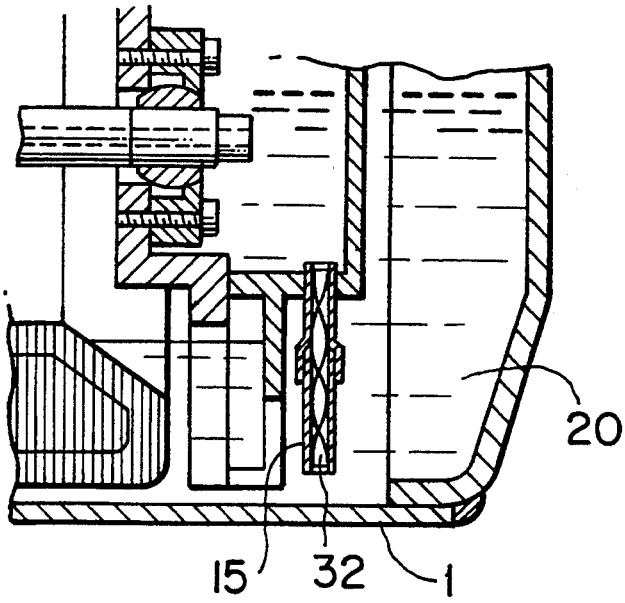
FIG. 10 is a sectional view of the essential part of an example in which a foreign-matter collecting section is provided inside the oil feeding pipe.
Figure 11:
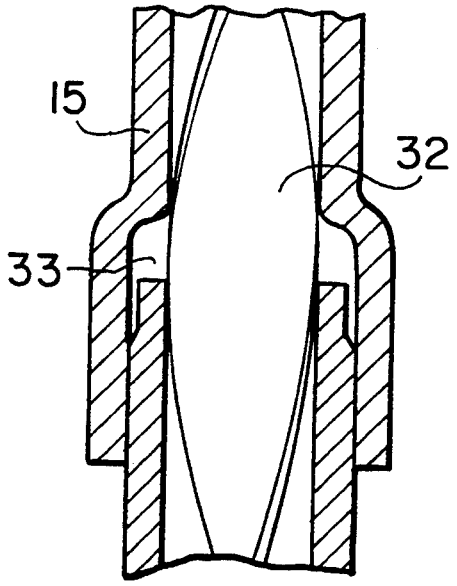
FIG. 11 is an enlarged view of the foreign-matter collecting section of FIG. 10.

Next, the third embodiment of this invention will be described with reference to FIGS. 9 through 11.

If foreign matter contained in the refrigerating machine oil is sucked in through the oil feeding pipe 15, it may intrude into the area of the sliding parts, thereby causing damage. In view of this, the third embodiment adopts two types of foreign-matter collecting structures, which are shown in FIGS. 9 to 11.

Figure 9:
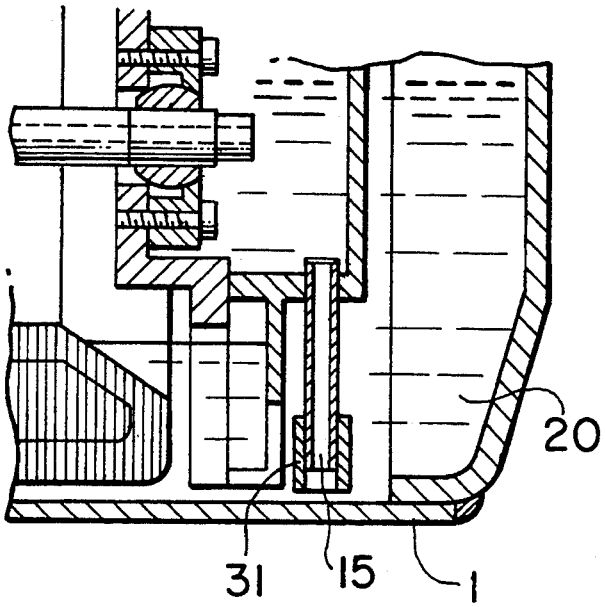
FIG. 9 is a sectional view of the essential part of an example in which a magnet is attached to the suction inlet of an oil feeding pipe.

In the structure shown in FIG. 9, a magnet 31 is provided in the vicinity of the suction inlet of the oil feeding pipe 15, thereby collecting iron-type foreign matter. In the structure shown in FIGS. 10 and 11, a spiral oil plate 32 is provided inside the oil feeding pipe 15, and a section 33 whose diameter is larger than that of the remaining sections of the bore of the pipe is formed between the suction inlet of and the discharge outlet of the pipe. Due to this structure, the oil sucked in the pipe makes a turning movement and foreign matter whose specific gravity is larger than that of oil rises along the inner wall of the pipe to be collected in the section 33. Thus, foreign matter is collected before the refrigerating machine oil reaches the sliding parts, thereby improving the reliability of the compressor.

Next, an embodiment of an air conditioner using a horizontal-installation-type scroll compressor according to any one of the above embodiments (i.e., the fourth aspect of this invention) will be described with reference to FIG. 13.

Figure 13:
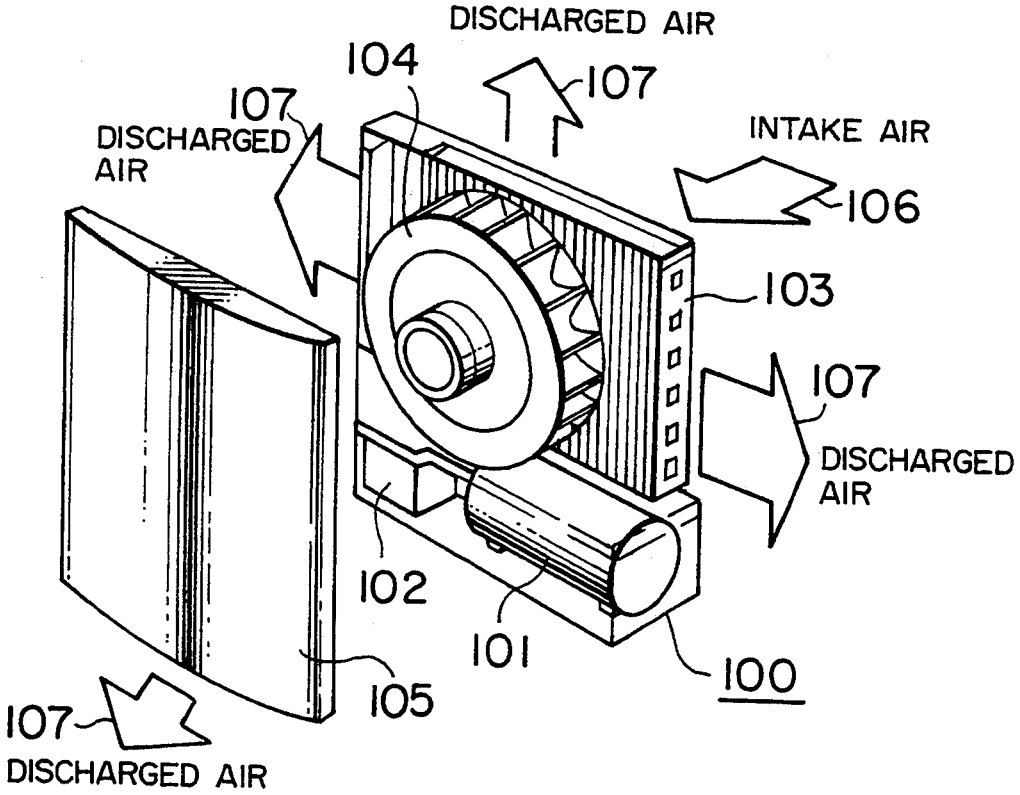
FIG. 13 is a perspective view showing the structure of the outdoor unit of an air conditioner according to an embodiment of this invention which uses a horizontal-installation-type scroll compressor as shown in FIG. 1.

Referring to FIG. 13, numeral 100 indicates an outdoor air conditioner unit; numeral 101, a horizontal-installation-type scroll compressor as described above; numeral 102, an inverter apparatus related to the electrical parts; numeral 103, a heat exchanger; numeral 104 a turbo fan related to a centrifugal fan, the blade section of the turbo fan 104 being situated in front of the heat exchanger 103; and numeral 105, a decorative panel arranged in front of the turbo fan 104 and constituting the front face of the cabinet of this unit.

As shown in FIG. 13, the scroll compressor 101 and the inverter apparatus 102 are arranged below the heat exchanger 103, the turbo fan 104, etc., which constitute the heat exchange section.

By operating the turbo fan 104, outside air is sucked in from the back surface of the heat exchanger 103, as indicated by the arrow 106 representing the intake air and, after heat exchange with the refrigerant flowing through a tube in the refrigeration cycle (not shown), it is blown out toward the outer periphery of the turbo fan 104, that is, in a centrifugal movement, as indicated by the arrows 107 representing the discharged air.

Although a turbo fan was adopted in the embodiment described with reference to FIG. 13, it is naturally also possible to adopt, for example, a sirocco fan.

As described above in detail, this invention provides the following advantages:

(1) A horizontal-installation-type scroll compressor requiring small installation space can be provided.

(2) A scroll compressor can be provided in which a reduction is effected in the amount of refrigerating machine oil permitted to be mixed with the refrigerant gas from the compressor and to circulate through the circulation system, thereby preventing reduction of the amount of oil inside the compressor and improving the reliability thereof, and in which the pressure loss inside the refrigeration cycle is reduced, thereby providing improved reliability.

(3) A scroll compressor can be provided which collects foreign matter contained in the lubricating oil supplied through the oil feeding pipe to the sliding sections, thereby attaining a high level of reliability.

(4) By using a horizontal-installation-type scroll compressor as described above, an air conditioner can be provided whose unit body excels in stability and can be made with small depth and which provides satisfactory ventilation efficiency, little pressure loss of refrigerant and high cyclic efficiency.

The air conditioner using the scroll compressor of this invention further provides the following advantages:

(1) The scroll compressor is more compact as compared to the rotary compressor, which has been generally used.

The rotary compressor performs one compression stroke with one rotation, whereas the scroll compressor discharges compressed gas after making several rotations. Thus, the volume change of the compression chamber per unit time of the rotary compressor is several times that of the scroll compressor. The scroll compressor is constructed such that liquid compression is hard to effect therein, so it requires no suction tank, which makes it even more compact.

Further, the vibrations in the scroll compressor are relatively small, so that the number of turns for absorbing vibrations of the piping system, which turns have conventionally been provided, may be relatively small, thereby reducing the space occupied by the piping system.

As a result of the reduction in the space occupied by the piping and the disuse of a suction tank, the volume of a machine chamber in which a scroll compressor is installed is substantially half the volume of a machine chamber lodging a rotary compressor.

(2) Since the scroll compressor and the inverter apparatus are arranged below the heat exchange section, the center of gravity of the unit is relatively low, thereby improving installation stability. Thus, if the depth of the cabinet is made small, better stability can be obtained as compared to the conventional unit in which a vertical-installation-type compressor is arranged side by side with the heat exchange section.

Further, the use of a centrifugal fan for the blower also contributes to a reduction in the unit depth, a turbo fan, sirocco fan, etc. having a configuration with a relatively small depth.

(3) The configuration of the cabinet as viewed from the front is substantially square and the front surface thereof is formed of a decorative panel, so that the unit offers an improved appearance from the designing point of view.

(4) Since a centrifugal fan is employed for the blower, outside air is sucked in from the back of the heat exchanger and blown out toward the circumference thereof, so that a sufficient amount of discharged air with respect to intake air is ensured, thereby providing improved ventilation efficiency and making it possible for the heat exchanger to be more compact.

(5) Since the scroll compressor involves little vibration and the piping system thereof is short, it is possible to use fat pipes in the piping of the refrigeration system. Accordingly, the pressure loss of the refrigerant is reduced and the cyclic efficiency is enhanced, thereby providing a highly reliable air conditioner.

What is claimed is:

1. A scroll compressor comprising a closed container, an electric motor and a compression mechanism connected to said electric motor through a crankshaft, said compression mechanism, crankshaft and electric motor being lodged within said closed container, said compression mechanism including at least two scrolls each having a spiral lap protruding straight from an end plate, said two scrolls being engaged with each other with their laps being on the inner side, one scroll making an orbiting movement relative to the other scroll while being prevented from rotating, said scroll compressor being installed in such a way that said crankshaft is maintained substantially horizontal, said small compressor further comprising a separation plate which is resistant to gaseous fluid and which separates the interior of said closed container into a first space lodging said electric motor, crankshaft and compression mechanism and a second space having a discharge pipe for transferring compressed refrigerant gas from the closed container to an outer cycle, wherein a communicating section to allow communication between said two separated spaces is provided in the section of said separation plate which is below the center of rotation of said electric motor, wherein a back chamber is provided on the side of the orbiting scroll opposite to the lap thereof, the pressure of said back chamber being kept somewhere between a suction pressure and a discharge pressure, a sub-bearing rotatably supporting said crankshaft in the vicinity of that end of said crankshaft opposite to a joint section of the crankshaft leading to said compression mechanism, a support plate supporting said sub-bearing and being held by the inner peripheral surface of said closed container, said support plate having a cutout below a position corresponding to the outer periphery of a rotor of said electric motor, a cup covering said sub-bearing, said cup being secured to that section of said support plate which is on the side of said crankshaft end supported said sub-bearing, and wherein said cup has an oil feeding pipe communicating with the interior of said cup covering said sub-bearing and extending downwards from said cup into said second space within said closed container, said separation plate being provided between said oil feeding pipe and said support plate, and a gas passage being provided between said separation plate and said support plate.

2. A scroll compressor according to claim 1, wherein said support plate and said separation plate have communication holes which are situated above the center of rotation of said rotor and which extend perpendicularly to the planes of these plates.

3. A scroll compressor according to claim 2, wherein said separation plate has a cutout which is situated below a position corresponding to the outer periphery of the rotor and which extends downwards beyond the cutout of said support plate.

4. A scroll compressor according to claim 3, wherein a portion of said separation plate which is opposed to and wider than said oil feeding pipe extends over a range not reaching the suction inlet of said oil feeding pipe.

5. A scroll compressor according to claim 4, wherein a spiral groove is provided in that shaft section of said crankshaft which is fitted into the sub-bearing at said shaft end, said spiral groove extending over a range of said shaft section where it makes a sliding movement within said sub-bearing, except for a predetermined area from the rotor-side end of said shaft section.

6. A scroll compressor according to claim 4, wherein a pipe is attached to the communication hole of the support plate to form a gas passage, the discharge outlet of which is spaced apart by a predetermined distance from the inner wall of said closed container.

7. A scroll compressor according to claim 4, wherein an oil separator is provided in at least either of the communication holes of the support plate and the separation plate.

8. A scroll compressor according to claim 4, wherein an oil separator is provided in that section of the inner wall of said closed container which is opposed to the discharge outlet of the compression mechanism.

9. A scroll compressor according to claim 4, wherein a magnet is provided in the vicinity of the suction inlet of said oil feeding pipe.

10. A scroll compressor according to claim 4, wherein a spiral oil plate is provided inside said oil feeding pipe, and wherein a section whose diameter is larger than that of the remaining sections of the pipe is formed in the interior of the pipe, at a position between the suction inlet and the discharge outlet thereof.

11. An air conditioner of the type which is equipped with a heat exchanger, a blower for introducing outside air to said heat exchanger, and a machine chamber provided below them, wherein said machine chamber lodges at least electrical parts and a scroll compressor according to claim 1.

12. An air conditioner of the type which is equipped with a heat exchanger, a blower for introducing outside air to said heat exchanger, and a machine chamber provided below them, wherein said machine chamber lodges at least electrical parts and a scroll compressor according to claim 4.

13. An air conditioner according to claim 11, wherein said blower is a centrifugal blower whose blade section is positioned in front of said heat exchanger, and wherein the outside air is sucked in from the back surface of said heat exchanger and blown out toward the outer periphery of said centrifugal blower.

14. An air conditioner according to claim 12, wherein said blower is a centrifugal blower whose blade section is positioned in front of said heat exchanger, and wherein the outside air is sucked in from the back surface of said heat exchanger and blown out toward the outer periphery of said centrifugal blower.

15. An air conditioner according to claim 11, wherein the outer casing of said air conditioner is formed as a box which has a small depth and which is substantially square as seen from the front, and wherein the front surface of said centrifugal blower is formed of a decorative panel.

16. An air conditioner according to claim 12, wherein the outer casing of said air conditioner is formed as a box which has a small depth and which is substantially square as seen from the front, and wherein the front surface of said centrifugal blower is formed of a decorative panel.

17. An air conditioner according to claim 13, wherein the outer casing of said air conditioner is formed as a box which has a small depth and which is substantially square as seen from the front, and wherein the front surface of said centrifugal blower is formed of a decorative panel.

18. An air conditioner according to claim 14, wherein the outer casing of said air conditioner is formed as a box which has a small depth and which is substantially square as seen from the front, and wherein the front surface of said centrifugal blower is formed of a decorative panel.

* * * * *